US005852918A

United States Patent [19]

Hidding et al.

[11] Patent Number: 5,852,918

[45] Date of Patent: Dec. 29, 1998

[54] METHOD AND APPARATUS FOR PROCESSING RECEIVED POSTAL ITEMS

[75] Inventors: Gerhard Hidding, Heerenveen; Bertus Karel Edens, Drachten, both of Netherlands

[73] Assignee: Hadewe B.V., Drachten, Netherlands

[21] Appl. No.: 868,589

[22] Filed: Jun. 4, 1997

[30] Foreign Application Priority Data

Jun. 4, 1996 [NL] Netherlands ..... 1003265

[51] Int. Cl.[6] ..... B65B 43/26

[52] U.S. Cl. ..... 53/492; 53/493; 53/381.3; 364/478.02

[58] Field of Search ..... 53/492, 381.2, 53/381.1, 381.3, 381.5, 498, 493; 414/411, 412; 364/478.02, 478.03

[56] References Cited

U.S. PATENT DOCUMENTS 4,921,388 5/1990 Nelson .
5,034,985 7/1991 Keough ..... 382/1
5,175,979 1/1993 van der Werff et al. ..... 53/492
5,179,820 1/1993 van der Werff ..... 53/492
5,510,997 4/1996 Hines et al. ..... 53/493

FOREIGN PATENT DOCUMENTS 0 571 308 11/1993 European Pat. Off. .
95/17975 7/1995 WIPO .

*Primary Examiner*—James F. Coan
*Assistant Examiner*—Gene L. Kim
*Attorney, Agent, or Firm*—Burns, Doanne, Swecker & Mathis, L.L.P.

[57] ABSTRACT

In processing received postal items, of opened envelopes an image of an envelope (4) is recorded by means of a registration assembly (67, 71, 74). The registration assembly (67, 71, 74) is so configured relative to an inverting structure for inverting a front wall or a rear wall (42) of an envelope (4), that the recording of an image of one of the walls of an envelope (4) is carried out each time after the inversion of that wall (42). As a result, images of the front wall and the rear wall of the envelope can be recorded from the same side, independently of the orientation in which the envelope has been supplied. Moreover, images of the front wall and the rear wall can always be recorded from the same side.

12 Claims, 4 Drawing Sheets

METHOD AND APPARATUS FOR PROCESSING RECEIVED POSTAL ITEMS

BACKGROUND OF THE INVENTION

This invention relates to an apparatus and a method for processing received postal items.

Such an apparatus and such a method are described in international patent application WO 95/17975. Described in this publication is a registration assembly in the form of a bar code reader to be used for scanning from envelopes information present on these envelopes, such as a bar code.

Envelopes cut open along three of the four folding edges are separated from the documents received therein by transporting the envelopes with the closed folding edge in trailing position, with suction means pulling one wall off the other wall of an envelope and inverting it, and with the documents being further transported along a track connecting to the supply track along which the envelopes, with those documents in them, are supplied.

A drawback of this apparatus is that the side of the envelope which bears the image to be scanned should be oriented in a predetermined direction when the envelope is being supplied, in order to pass it along the bar code reader with the side bearing the bar code turned to the bar code reader.

SUMMARY OF THE INVENTION

It is an object of the invention to provide an apparatus and a method whereby the scanning of images from the envelopes can be carried out in a simple and efficient manner.

This object is achieved according to a first aspect of the present invention by providing an apparatus for processing received postal items, comprising a registration assembly for recording an image from an envelope, and an inverting structure for inverting a front wall or a rear wall of an envelope at least weakened along at least all but one of the folding edges between the front wall and the rear wall, relative to the rear wall or the front wall, respectively, of that envelope, wherein the inverting structure and the registration assembly are configured for performing the recording of an image of at least one of the walls of an envelope after the wall of that envelope has been inverted and the envelope has been brought into a position opposite the registration assembly.

According to another aspect of the invention, this object is achieved by including in a method for processing received postal items of which envelopes have at least been weakened along at least all but one of the folding edges between a front wall and a rear wall, the steps of recording an image of the envelope, and inverting a front wall or a rear wall of each envelope relative to the rear wall or the front wall, respectively, of that envelope, and by carrying out the recording of the image of each envelope after the inversion of the front wall or the rear wall of the respective envelope.

Since in the practice of the invention an image is recorded from the envelope after the front wall or the rear wall has been turned over, images of the front wall and the rear wall of the envelope can be recorded from the same side, which side, moreover, is independent of the orientation in which the envelope is supplied.

This means that with a registration structure on one side of the envelopes, images of both the front wall and the rear wall of those envelopes can be recorded. Also in the case where an image of only one wall is to be recorded, the invention can be practised with advantage, because it is possible, in practicing the invention, to record an image in each case with a registration structure on one side of the envelopes, even if it is not priorly known on which of the two walls of the envelope that image is located, which is the case if the envelopes have been included in random orientations in the stack as supplied.

In practice of the invention, regardless of the orientation in which an envelope is supplied, always on the same side of the envelopes an image present on the outside or on the inside of each of those envelopes is recorded.

The recorded images can for instance be filed as a part of the filing of incoming mail, for instance to enable identification of the sender in cases where this does not appear from the contents of the envelope. Images of an envelope can also serve for determining the further sorting of the contents of the envelope, for instance on the basis of the bar code, as known per se, but also on the basis of recognition of certain indicia, such as predetermined marks, designations such as "attention . . . " and logos, names and/or addresses of certain senders.

Recording an image can be carried out in many ways, depending on the application contemplated, for instance by scanning the envelope moving relative to the registration assembly, using a video camera, or by photographic recording on microfilm.

Particular embodiments and elaborations of the invention are further described in the depending claims.

Hereinafter, the invention is further illustrated and explained on the basis of the exemplary embodiment presently preferred most, with reference to the drawings.

DETAILED DESCRIPTION OF MODES OF THE INVENTION

Figure 1:
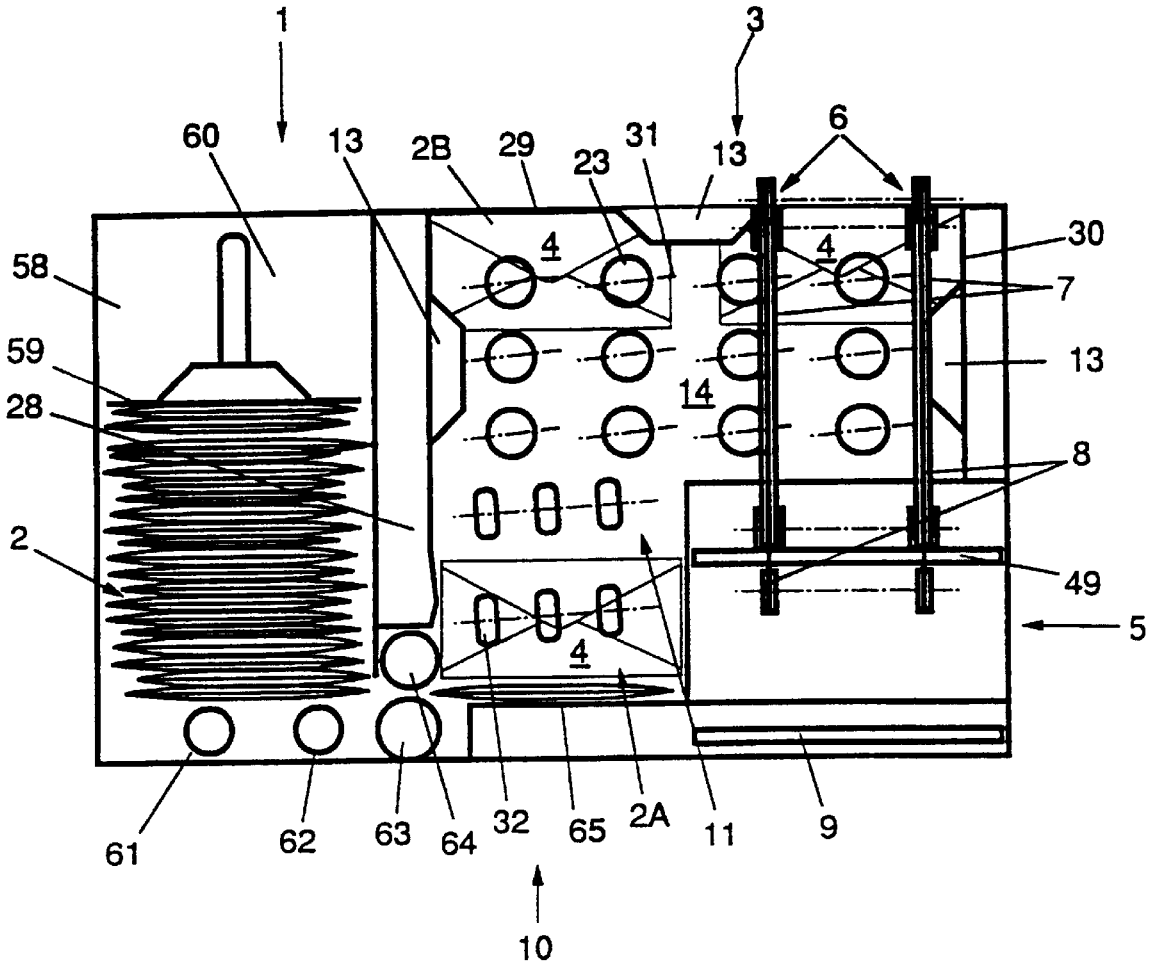
FIG. 1 is a schematic top plan view in cross section of the apparatus according to the invention.

The exemplary embodiment of an apparatus according to the invention as shown in the drawings represents the presently most preferred embodiment of the invention. The basis lay-out of this apparatus corresponds to that of an apparatus for extracting contents from envelopes which is manufactured by HADEWE B.V. of Drachten the Netherlands, and is commercially available under the type designations IM-35 and LE-1. Further, for more details of this apparatus, reference is made to U.S. Pat. Nos. 5,179,820 and 5,175,979, whose content is incorporated herein by reference.

Figure 2:
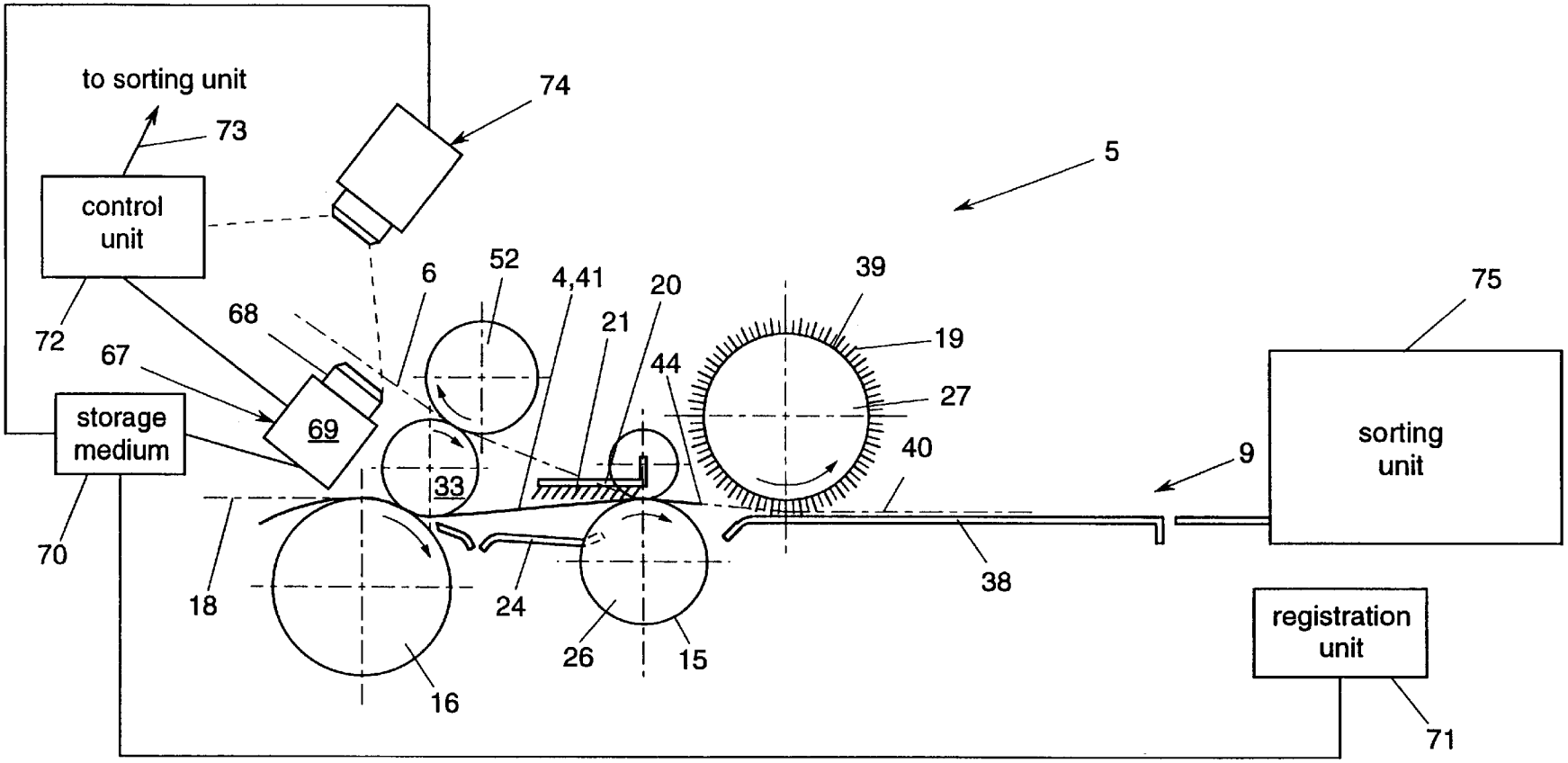
FIGS. 2–4 are cross-sectional side elevational views of the separating portion of the apparatus according to FIG. 1 in successive operating stages.
Figure 3:
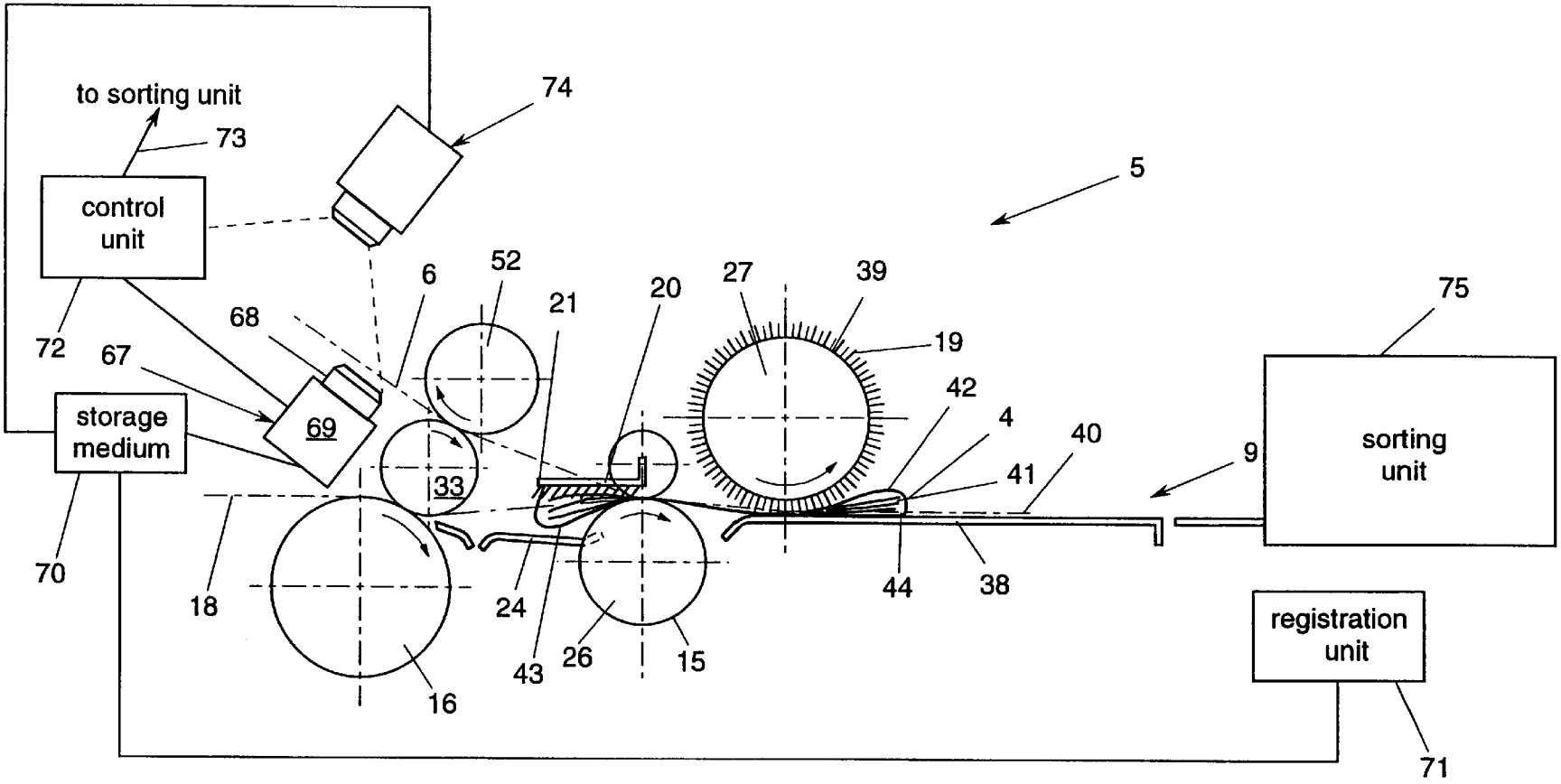
Figure 4:
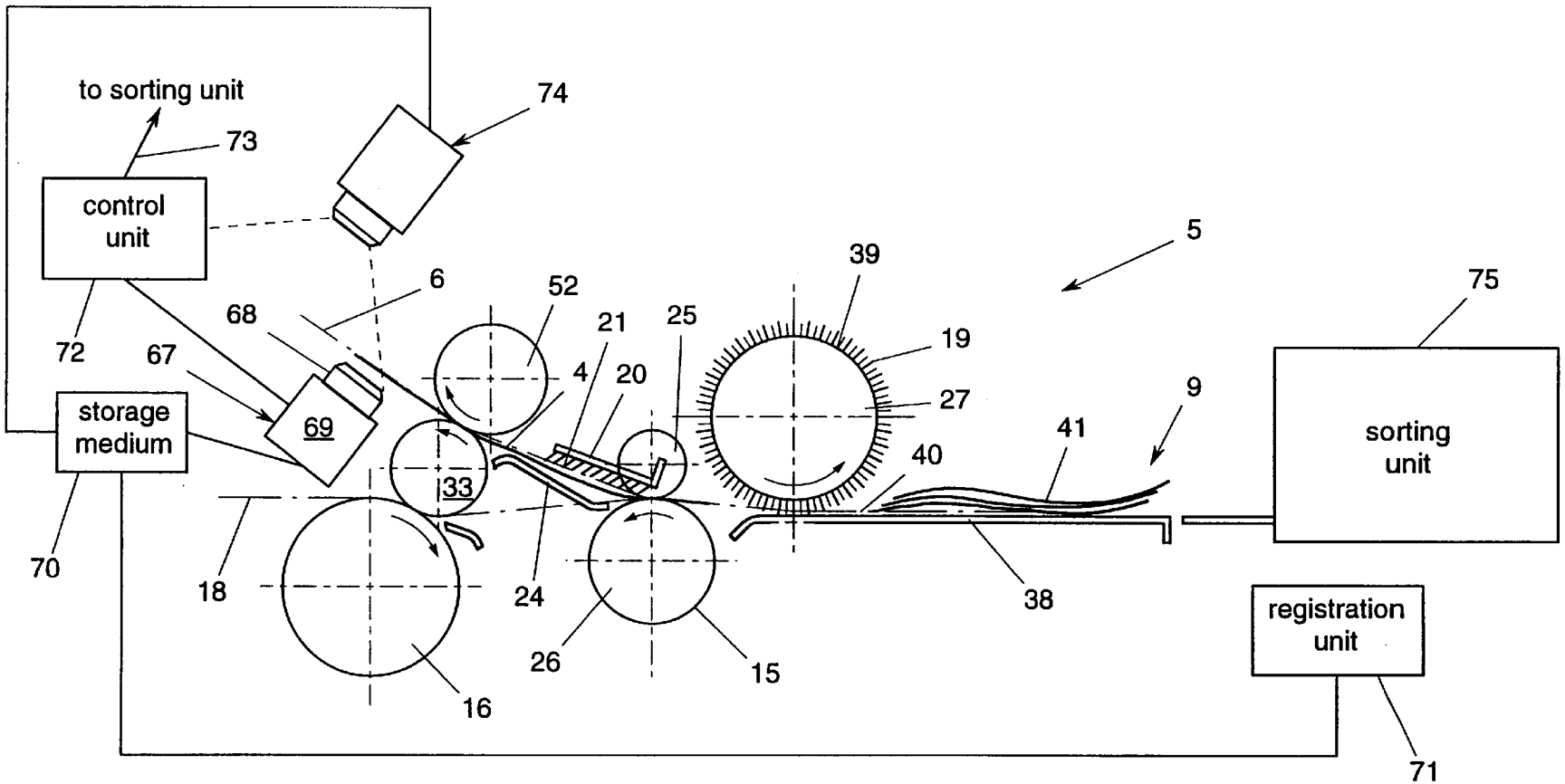

The apparatus according to the exemplary embodiment of the invention as shown comprises three main processing stations: first, a holder station 1 for accommodating and supplying piece by piece postal items 2 to be processed, second, an opener 3 for separating a front wall and a rear wall of an envelope 4 of a postal item 2 from each other along three of the folding edges of that envelope 4, and third, a separator 5 for separating the envelope 4 from its contents (this separator is shown in greater detail in FIGS. 2–4).

The holder station 1 for supplying postal items 2 piece by piece is provided with a storing space 58 in which the postal items to be processed can be placed. Mounted in the storing space is a hold-down support 59 for sliding movement along a guideline slot 60. The hold-down supporter 59 is connected with means (not shown) for pushing the stack of postal items 2 to be processed to the operating side 10. Provided on the operating side 10 of the storing space 58 are a support roller 61 and a supply roller 62. Further, near the operating side 10 on the side of the opener 3 a transport roller 63 and a separation roller 64 are mounted, the transport roller 63 being arranged on the operating side 10 of the separation roller 64.

For processing a stack of postal items, the hold-down support 59 is moved away from the operating side 10 and the stack of postal items 2 is placed horizontally between the hold-down support 59 and the supply rollers 61 and 62, so that the envelope are in a line one behind the other in substantially upright position. Then the hold-down support 59 is pressed against the stack of postal items 2 for exerting a press-on force on the stack in the direction of the operating side 10. When the apparatus is operated for processing a postal item, the supply roller 62 and the transport roller 63 are actuated. Further, the separation roller 64 is driven, but it travels along with the transport roller 63 as long as no more than one postal item 2 is disposed between the separation roller 64 and the transport roller 63.

The action of the supply roller 62 causes the outermost postal item on the operating side 10 of the stack to be moved towards the transport roller 63, which carries the postal item along upon engagement with it. After the transport roller 63 engages the outermost postal item, the drive of the supply roller 62 is disengaged. Any following postal items that are carried along by the outermost postal item are restrained by the separation roller 64 and upon entering the area between the transport roller 63 and the separation roller 64 are returned to storing space 58 by the separation roller 64.

The outermost postal item is transported by the transport roller 63 to be arranged before a wall 65 on the operating side 10 of the opener 3. Then the postal item is tilted away from said wall 65 for the item to assume a flat position lying on the guiding surface 14. From this flat position, the postal item is transported further to the opener 3.

The opener 3 for severing the front wall and the rear wall of each envelope along three of the folding edges comprises a rectangular guiding surface 14 having, as viewed from the operating side 10, a left-hand guiding edge 28, a rear guiding edge 29 and a right-hand guiding edge 30. For transporting a postal item 4 along these guiding edges 28, 29 and 30, the opener 3 is provided with driven and steerable transport rollers 23. Each of the guiding edges 28, 29 and 30 is provided with a cutting member 13 arranged substantially centrally and operative at some distance from the respective guiding edges for cutting open the envelope along a folding edge.

The opener has a supply opening 11 between the holder station 1 and the separator 5. In the area of this supply opening 11 transport rollers 32 are arranged obliquely with respect to the left-hand guiding edge 28, so that postal items 2 upon being transported through the opening 11 are urged against the left-hand guiding edge 28.

When a postal item is fed through the supply opening 11 from a position designated by the reference numeral 2A, the rollers 23 are rotated, their centre lines 31 being held in a position substantially transverse to the left-hand guiding edge 28. The centre lines 31 may be held in a slightly oblique position, with the right-hand side of each of the rotationally symmetrical elements being disposed at a greater distance from the operating side than the left-hand side, as shown in FIG. 1. Thus the postal item is continuously urged against the left-hand guiding edge 28. Upon passing the cutting member 13 provided along the left-hand guiding edge 28, the postal item is cut open along the folding edge of the envelope that is turned towards this left-hand guiding edge 28.

The postal item is transported along the left-hand guiding edge 28 until it reaches the rear guiding edge 29. The position in which the rear guiding edge 29 has been reached is designated by the reference numeral 2B in FIG. 1. Then the rollers 23 are rotated about corresponding axes transverse to the guiding surface 14 until the centre lines 31 are in a position substantially transverse to the rear guiding edge 29. The centre lines 31 of the rotationally symmetrical elements may be held in an oblique position relative to the rear guiding edge 29 in a similar way as described with reference to the left-hand guiding edge 28. Upon passing the cutting member 13 provided along the rear guiding edge 29, the envelope is cut open along the second folding edge turned towards this guiding edge 29.

When the postal item subsequently reaches the right-hand guiding edge 30, the rollers are rotated about associated steering axes in a similar way as when reaching the rear guiding edge 29. The position in which the right-hand guiding edge 30 has been reached is designated by reference numeral 2C in FIG. 1. As a result, the postal item is passed along the right-hand guiding edge 30 to the separator 5. The envelope is thereby cut open along the third folding edge turned towards this guiding edge 30.

The separator 5 has a supply opening contiguous to the surface 14 of the opener 3 and a transport track 18 extends through that opening (see FIGS. 2–4). The separator 5 further has an exit 9 on the operating side 10 for discharging processed contents and, in an upper position, a discharge opening 49 for discharging processed envelopes.

The separator 5 is adapted for unfolding the envelope 4 and for transferring the envelope 4 in an unfolded condition to an exit track 6 for discharging envelopes 4 which have been separated from their contents.

A portion of the exit track 6 is designed in the form of superjacent and subjacent belts 7 and 8 of resilient material, between which belts an envelope can be clamped. If necessary, an envelope can easily be removed by hand from between the belts 7 and 8. In the exit track 6, any part of the contents that happens to be removed along with the envelope is not separated from the envelope in an uncontrolled manner, which might lead to that part being lost.

The separator 5 is further described with reference to FIGS. 2–4 in which an example of a separator 5 is shown in combination with an envelope 4 and a contents 41 being processed, in successive operating stages. The envelope has a first wall or panel 42 and a second wall or panel 43 (in FIG. 3 separately visible), which are mutually connected along a fold 44 along the fourth side.

A transport track 40 extends through the station, along which track a guiding plate 24, a guiding roller 25, a transport roller 26, a friction roller 27 and a retaining surface 38 are provided. The friction roller 27 and the retaining surface 38 form friction surfaces arranged on opposite sides of the transport track 4, and facing each other. When the envelope is supplied (FIG. 2) the friction roller 27 is in a position lifted from the retaining surface 38, so that the envelope can be brought in a position between the friction roller 27 and the retaining surface 38 by rotating the transport roller 26 and the guiding roller 25. The friction roller 27 and the retaining surface 38 can be pressed towards each other with a press-on force for exerting a pressure on the envelope (FIG. 3) and can be moved relative to each other parallel to the transport track 40. This is achieved by retaining the retaining surface 38 relative to the position of the transport roller 26 and the guiding roller 25, and urging the friction roller 27 towards the retaining surface 38 and rotating it in such a way that portions of the circumference 39 of the friction roller 27 facing the retaining surface 38 move away from the guiding roller 25 and the transport roller 26. Preferably, the transport roller 26 is kept blocked and the guiding roller 25 rotates freely with the displacements of the wall 42, 43 of the envelope 4 with which it is in contact.

The envelope 4 is thereby clamped between the friction roller 27 and the retaining surface 38, and a portion of the first wall 42 against which the friction roller 27 is pressed, is slid relative to the second wall 43 in the direction of the fold 44 and pivoted about the fold 44 (see FIG. 3). When the first wall 42 is unfolded, the contents 41 are accessible to the friction roller 27 and the contents 41 which lie on the second wall 43, are slid over the first wall 42 in the direction of the free edge thereof opposite the fold 44 until the contents 41 are free from the friction roller 27.

As appears from FIG. 4, the friction roller 27 is lifted off the retaining surface 38 after the contents 41 of the envelope 4 have come clear of that roller 27. Then the transport roller 26 is rotated in such a direction that portions of its circumference 15 facing the guiding roller 25 move away from the retaining surface 38. The guiding plate 24 is part of a switch structure connecting the envelope supply track 18 and an exit track 6 for emptied envelopes 4 with the transport track 40. In FIG. 4 the guiding plate 24 is extended upwards so as to guide the envelope 4 supplied by the transport roller 26 to the beginning of the exit track 6, which beginning is formed by oppositely arranged portions of an intermediate roller 33 between a supply roller 16 of the supply track 18 and a discharge roller 52 of the exit track 6.

Since the envelope 4 is removed in a direction substantially opposite to the direction of the sliding movement of the first wall 42 and the contents 41 are slid in the direction of that sliding movement, the envelope 4 is automatically separated from its contents 41.

Arranged concentrically with the friction roller 27 are sweeping means 19 which can be rotated along the retaining surface 38 with a slight pressure. Any contents 41 which may have been carried along with the envelope 4 upon its removal are swept off the envelope 4 by rotation of the sweeping means 19, preventing contents from being carried along with envelopes. By restraining the sweeping means 19 from rotation relative to the friction roller 27, their sweeping action can be controlled by continuing the rotation of the friction roller after it has been lifted off the envelope 4. The sweeping means 19 further support the pivotal movement of the first panel 42 of the envelope, after it has come clear of the friction roller 27.

Spaced from the transport track 40 and the friction roller 27, a restraint 20 is provided. The friction roller 27 and the restraint 20 are disposed on the same side of the transport track 40, and the portion of the circumference 39 of the friction roller 27 facing the retaining surface 38 is moveable away from the restraint 20.

When in the area of separation edges opposite the fourth folding edge 44 connections between the first and the second panel 42 and 43 are present, a portion of that envelope 4 adjoining the separation edges opposite the fourth folding edge 44 curls and, from the moment when a certain degree of curling is reached, the separation edge of the second panel 43 opposite the fourth folding edge 44 is at least locally prevented from following the first panel 42 (see FIG. 3). As a result, the first and the second panel 42 and 43 are drawn apart along the separation edge opposite the fourth folding edge 44, so that the remaining connections between the first and the second panel 42 and 43 are ruptured. The envelope 4 is now unfolded in spite of the separation edge opposite the fourth folding edge 44 not having been cut open completely.

According to the embodiment shown, the restraint 20 comprises a short-haired brush 21, so that the separation edge of the second panel 43 is reliably restrained substantially directly upon checking the restraint 20, regardless of the position where it meets the restraints 20.

The switch formed by the guiding plate 24 is disposed on the same side of the friction surfaces 27, 28 as the restraint 20. Thus, as explained hereinabove, the envelope 4 can readily by discharged in a direction opposite to the direction of discharge of the contents 41. A further advantage is that the guiding plate 24 can be coupled with the restraint 20, so that the plate 24—as shown in FIG. 4—can be pivoted upwards away from the transport track 40 for guiding a processed envelope 4 to the exit track 6.

When the processing of an envelope 4 has passed the stage shown in FIG. 3 and the first panel 42 as well as the contents 41 between the friction roller 27 and the retaining surface 38 have been removed, so that only the second panel 43 of the envelope 4 is left between the friction roller 27 and the retaining surface 38, operation of the friction roller 27 is to be interrupted. As discussed hereinabove, this is effected in the present embodiment by shifting the friction roller 27 away from the opposite retaining surface 38.

To determine the moment at which the operation of the friction roller 27 is to be interrupted, the apparatus is provided with a sensor for generating a signal dependent on the resistance the friction roller 27 is subject to, the sensor being coupled for interrupting the operation of the friction roller 27 when the resistance sustained by the friction roller 27 exceeds a predetermined level.

For recording images from envelopes of received postal items, the apparatus according to the invention is provided with a registration assembly or unit 67 for recording an image on an outside of each envelope 4. The registration assembly 67 is so positioned relative to the above-described inverting structure for pivoting the wall 42 of the envelope 4, that in operation the recording of an image of one of the walls 42, 43 of an envelope takes place after the wall 42 of an envelope 4 has been inverted and the inverted wall 42 of that envelope 4 been brought in a position opposite the registration assembly. To that end, in the apparatus according to the exemplary embodiment shown, the registration assembly 67 is arranged along the exit track 6 where the envelopes 4 successively pass in unfolded condition.

In operation, of each of the envelopes 4—which have at least been weakened along at least all but one of its folding edges between a front wall and a rear wall—first a front wall or a rear wall is inverted relative to the other wall. Subsequently, the envelope is separated from the documents received in that envelope 4. Each time after that, i.e. each time after the front or the rear wall of the envelope being processed has been inverted, an image reflected from the envelope 4 is recorded by means of the registration assembly 67.

Because in the practice of the invention a front wall or a rear wall of an envelope is inverted relative to the envelope's rear wall or front wall, respectively, and an image of the envelope is recorded after the front wall or the rear wall has been inverted, images of the front wall and the rear wall of the envelope can each time be recorded from the same side, independently of the orientation in which the envelope is supplied.

The registration assembly 67 is arranged on the side of the exit track 6 that connects to the side of the transport track 40 where the stationary retaining surface 38 is located opposite the movable friction roller 27 (this is the side of the transport track 40 where in operation the wall of the envelope that is folded over is folded towards), so that in operation the envelopes are always passed along the registration assembly 67 with the outer surfaces of the processed envelopes 4 turned towards the registration assembly 67.

The images recorded from the outer surfaces of the processed envelopes 4 can, for instance, be filed as a part of the filing of incoming mail, for instance in order to be able to determine the sender or the date of receipt in case this does not appear from the contents of the envelope.

In the apparatus according to the example shown, however, the registration assembly 67 is arranged close to the transport track and designed as a bar code reader. The scanned code can, for instance, be used for selecting a destination for the contents of the envelope, for categorizing images recorded from the contents of that envelope, or for registering the extent of response from certain groups to whom, for instance as part of a mailing, reply envelopes have been sent. It is also possible, when using suitable registration equipment, to recognize certain indicia in the recorded image, such as pre-defined marks, designations such as "attention . . . ", and logos, names and/or addresses of certain senders, and to use these for further sorting or other purposes.

Recording an image can be accomplished in many ways, depending on the application contemplated. To that end, the registration assembly, rather than being designed for scanning the envelope 4 moving relative to the registration assembly 67, can for instance be designed as a video camera or as a microfilm camera for recording an image of an envelope being stationary relative to that camera. Such registration equipment is known per se and commercially available. A further description thereof has therefore been dispensed with.

It is possible to couple to the registration assembly 67 a storage medium for storing information representing recorded images, as is diagrammatically indicated in FIGS. 2–4 with the block 70. Further, connected to this storage medium 70 is a second registration assembly for recording and registering images of documents downstream of the separator 5 (block 71). By configuring the registration assemblies 67 and 71 and the storage medium 70 for storing in mutual association information that represents an image recorded from an envelope as well as at least one image recorded from at least one document extracted from that envelope, it is possible, for the purpose of paperless processing of incoming mail (for instance digitally or on microfilm), to store in a simple manner the information recorded from the envelope in association with the information recorded from the documents.

According to the example shown, the registration assembly 67 comprises a scanner 68 and a data processor 69 for processing digital data. The storage medium 71 is designed as a digital memory structure for storing data representing scanned images, coming from the registration assemblies 67, 71 and further contains a program for storing in mutual association, firstly, data representing images scanned from envelopes, and, secondly, data representing images scanned from documents belonging to those envelopes. Thus in a reliable automated manner a file with information regarding images recorded from documents and from envelopes in which those documents have been received, can be obtained.

However, also when the registration assemblies 67, 71 are designed as microfilm cameras and a microfilm is used as storage medium, in a simple and efficient manner information regarding received envelopes can be stored on microfilm in association with information regarding documents received in those envelopes.

By recording with the registration assembly 71 not only the images of the envelopes 4 but also the images of the documents 41 separated from those envelopes 4, a single registration assembly for recording images from documents and envelopes can suffice. In the apparatus according to the exemplary embodiment shown, this operative condition can be realized by delivering the envelopes not via the exit track 6 but via the exit 9 each time upon the separation of envelope and document or documents, in the wake of the associated documents, and passing them along the registration assembly 71.

Because in many cases it is not predictable in which orientation documents are placed in an envelope, they can be manually brought into the proper orientation relative to the registration assembly 71. It is also possible to adapt the registration assembly 71 for scanning the passing documents from two sides. Obviously, means for mutually separating documents can be integrated into the proposed apparatus. Such facilities are known in the field of document processing equipment in many variants.

The images recorded from the envelopes 4 can also be used in sorting documents received in those envelopes. To that end, there is connected to the registration assembly a control unit 72 for generating sorting signals in response to signals delivered by the registration assembly 67, which signals correspond with the image scanned from the envelope 4. On the basis of the sorting signals that are transmitted via a line 73 to a sorting unit, a sorting station downstream of the separator can be actuated for selectively directing documents to one of at least two destinations for documents, in response to an image recorded from the envelope in which those documents have been received.

Because in the apparatus according to the exemplary embodiment shown the opener 3 for cutting open or at least weakening all but one of the folding edges between a front wall and a rear wall of each envelope 4 is integrated into the apparatus upstream of the inverting structure, unopened envelopes can be processed. Moreover, the inversion of one wall of each envelope relative to the other wall of the envelope in question is facilitated, because the inversion of the front wall or the rear wall of the opened envelope relative to the other of the walls of that envelope is carried out by unfolding the envelope about the folding edge of that envelope which has been left wholly or partly intact. The opener 5 of the apparatus according to the example shown at the same time forms the structure for inverting one wall of each envelope relative to the other wall of the envelope in question and is adapted for unfolding an envelope 4.

Also the registration of images of the envelope 4 is simplified in that each time a single image can be recorded which represents at least portions of both the front wall and the rear wall. In addition, the further processing of the envelopes is also rendered simpler if the front wall and the rear wall remain coupled to each other.

Instead of serving for the registration of images of the outside of each envelope, the recorded image can also serve for registering images of the insides of the envelopes. This makes it possible, for instance with the aid of image recognition techniques, to determine if a content or a part thereof is being carried along with the envelope. Instead, or supplemental thereto, stored images of the insides of the walls of the envelopes can also be used to consult these images afterwards with the naked eye if in the processing of the content of an envelope it is found that a part of the content is missing. With the image or the images of the inside of the envelope at hand, it can then be quickly checked if a part of a content has been carried along with that envelope.

The apparatus according to the exemplary embodiment shown is adapted for recording images of both sides of the front wall and the rear wall of each envelope 4. To that end, on the side located opposite the earlier discussed registration assembly 67, along the exit track 6 a further registration assembly 74 is arranged. This registration assembly 74 is also connected to the storage medium.

It is noted, finally, that within the framework of the present invention many other exemplary embodiments are conceivable. It is possible, for instance, to use a vacuum drum for separating envelopes from the documents received therein or to sever the envelope walls completely from each other and each time to invert one of the walls of an envelope. To that end, for instance a folding apparatus of which the buckle chute is suitably set can be used. Also, the separation of content and envelope can be omitted if it is desired to leave the envelopes with the content. The images scanned from the envelopes can then serve, for instance, for sorting envelopes together with the associated contents. If no separation takes place, obviously no separation structure for separating envelopes from the contents received therein is needed.

We claim:

1. An apparatus for processing received postal items, comprising:

a registration assembly for recording an image from an envelope, and an inverting structure for inverting a front wall or a rear wall of an envelope at least weakened along at least all but one of the folding edges between the front wall and the rear wall, relative to the rear wall or the front wall, respectively, of that envelope, wherein the inverting structure and the registration assembly are configured for performing the recording of an image of at least one of the walls of an envelope after the wall of that envelope has been inverted and the envelope has been brought into a position opposite the registration assembly.

2. An apparatus according to claim 1, wherein upstream of the inverting structure an opener is disposed for at least weakening all but one of the folding edges between a front wall and a rear wall of each envelope.

3. An apparatus according to claim 1, wherein the inverting structure is arranged for unfolding an envelope.

4. An apparatus according to claim 1, further comprising a storage medium, coupled to the registration assembly, for storing information representing recorded images, the registration assembly and the storage medium being configured for storing, in mutual association, information representing images recorded from an envelope as well as from at least one document removed from that envelope.

5. An apparatus according to claim 4, wherein the registration assembly comprises a scanner and a data processor and wherein the storage medium is designed as a memory structure for storing data representing scanned images coming from the registration assembly, which memory structure further contains a program for storing in that memory structure, in mutual association, data representing images scanned from envelopes and data representing images scanned from documents associated with those envelopes.

6. An apparatus according to claim 4, wherein the registration assembly is a microfilm camera and wherein the storage medium is a microfilm.

7. A method for processing received postal items of which envelopes have at least been weakened along at least all but one of the folding edges between a front wall and a rear wall, comprising the steps of recording an image of the envelope, and inverting a front wall or a rear wall of each envelope relative to the rear wall or the front wall, respectively, of that envelope, wherein the recording of the image of each envelope occurs after the inversion of the front wall or the rear wall of the respective envelope.

8. A method according to claim 7, starting from envelopes of which at least all but one of the folding edges between the front wall and the rear wall of each envelope have at least been weakened and one folding edge is left substantially intact, wherein the inversion of the front wall or the rear wall of the opened envelope relative to the other of the walls of that envelope is performed by unfolding the envelope about the folding edge of that envelope which has been left substantially intact, and wherein each time one image is recorded which represents at least portions of both the front wall and the rear wall.

9. A method according to claim 7, wherein in each case one of at least two destinations for at least one document from a particular envelope is selected in response to signals delivered by the registration assembly, which signals correspond with the image recorded from the envelope and wherein in each case at least one document removed from the envelope of which an image has been recorded is directed to said selected one of said destinations.

10. A method according to claim 7, wherein moreover in each case an image is recorded of at least one document coming from an opened envelope and wherein in each case data representing an image recorded from the envelope and data representing images recorded from a document separated from one of those envelopes are stored in mutual association.

11. A method according to claim 7, wherein additionally images are recorded from documents coming from opened envelopes, and wherein the images of the envelopes and the images of the documents are recorded by the same registration assembly.

12. A method according to claim 7, wherein in each case images of two sides of the front wall and the rear wall of an envelope are recorded.

* * * * *